US008011840B2

(12) United States Patent
Asahina

(10) Patent No.: US 8,011,840 B2
(45) Date of Patent: Sep. 6, 2011

(54) WARNING NOTIFICATION AT COVER OPEN IN PRINTER

(75) Inventor: Shigetoshi Asahina, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 798 days.

(21) Appl. No.: 12/023,658

(22) Filed: Jan. 31, 2008

(65) Prior Publication Data

US 2008/0193186 A1 Aug. 14, 2008

Related U.S. Application Data

(60) Provisional application No. 60/889,497, filed on Feb. 12, 2007.

(51) Int. Cl.
*B41J 29/13* (2006.01)
*B41J 29/38* (2006.01)

(52) U.S. Cl. ..... 400/76; 400/283; 400/355; 400/356; 400/124.13

(58) Field of Classification Search ..... 400/283, 400/355, 356, 124.03, 124.13
See application file for complete search history.

(56) References Cited

U.S. PATENT DOCUMENTS

| | | | | |
|---|---|---|---|---|
| 4,664,542 | A * | 5/1987 | Tsugita | 400/124.13 |
| 2005/0195230 | A1 * | 9/2005 | Kanematsu et al. | 347/14 |
| 2007/0165094 | A1 * | 7/2007 | Matsumura et al. | 347/223 |

FOREIGN PATENT DOCUMENTS

| | | | |
|---|---|---|---|
| JP | 64-016675 | | 1/1989 |
| JP | 02235675 | A * | 9/1990 |
| JP | 02245366 | A * | 10/1990 |
| JP | 08039794 | A * | 2/1996 |
| JP | 09164701 | A * | 6/1997 |
| JP | 2000355138 | A * | 12/2000 |
| JP | 2002-014556 | | 1/2002 |
| JP | 2006116867 | A * | 5/2006 |

* cited by examiner

*Primary Examiner* — Daniel J Colilla
(74) *Attorney, Agent, or Firm* — Turocy & Watson, LLP

(57) ABSTRACT

In a case where temperature of a print head mounted on a head carrier becomes a specified temperature or higher during use, a head carrier is retracted to a retracting section in a housing of a printer, so that it is hardly touched by a user's hand. The retracting to the retracting section can also be linked to opening of a printer cover.

9 Claims, 4 Drawing Sheets

$E = \alpha \sin \theta$

WARNING NOTIFICATION AT COVER OPEN IN PRINTER

BACKGROUND OF THE INVENTION

1. Field of the Invention

The present invention relates to a printer, and particularly to a printer in which consideration is given to opening of a cover of the printer.

2. Description of the Related Art

In general, a cover of a printer can be opened in view of the maintenance of a print head, exchange of an ink ribbon, countermeasures against a jam of a sheet, and the like. The opening of the cover can be detected by, for example, a sensor provided in a printer main body. By using this, an alert at the time of the opening of the cover can be notified to the user. Besides, there is also a case where countermeasures at the time of cover open are recited in a user's manual.

On the other hand, when printing is continued, the print head of the printer gets hot. Although the heated print head is cooled by the surrounding air, it takes much time for the print head to be sufficiently cooled.

There is a printer in which in order to notify the user of the change of a temperature state of a heating portion, such as a fixing unit, in the inside of the apparatus, a temperature display member such as "Caution to high temperature" is provided (JP-A-2002-14556). Besides, there is a printer in which the temperature rise of a print head is detected by a temperature detector incorporated in the print head, cooling is performed, and warning means performs a display for a specific time immediately before the temperature of the print head is lowered to a printable temperature (JP-B-1-16675).

BRIEF SUMMARY OF THE INVENTION

It is an object of the present invention to provide a printer in which measures are taken according to the temperature of a print head.

In an aspect of the present invention, a printer includes a head carrier on which a print head is mounted, a temperature sensor to detect temperature of the print head, a retracting section that is provided at one end side of a span in which the head carrier travels and that shields the print head, and a control unit to control respective units of the printer, wherein the control unit moves the head carrier to the retracting section in a case where the temperature of the print head detected by the temperature sensor is a first specified value or higher.

DETAILED DESCRIPTION OF THE INVENTION

Throughout this description, the embodiments and examples shown should be considered as exemplars, rather than limitations on the apparatus and methods of the present invention.

Hereinafter, an embodiment of a printer of the invention will be described in detail with reference to the drawings.

In this embodiment, although the description will be made while a dot printer is used as an example, it is a matter of course that the invention is not limited to the dot printer.

Figure 1:
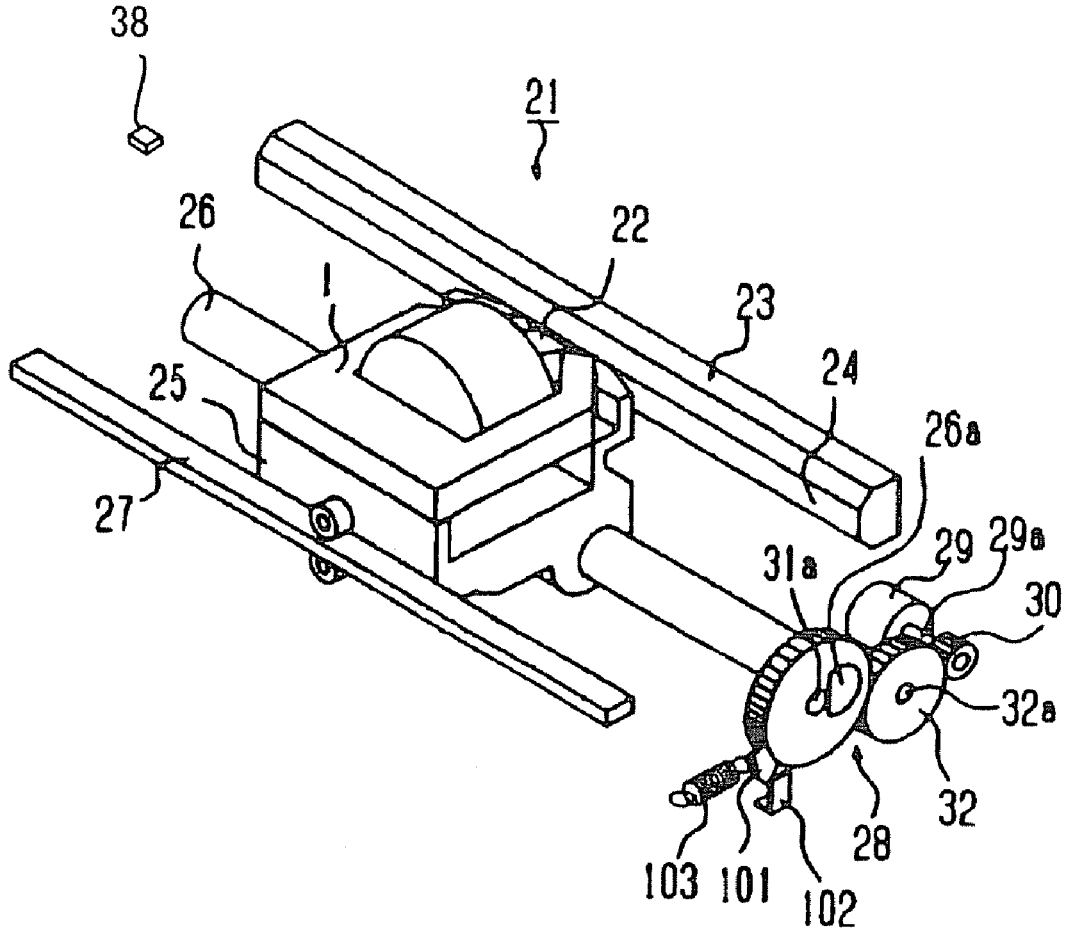
FIG. 1 is a perspective view showing a schematic structure of a print unit provided in a printer of an embodiment of the invention.

A print unit provided in a printer will be described. As shown in FIG. 1, a print unit 21 to print on a print medium (not shown) includes a print head 22 and a platen 23. The platen 23 is a rod-like member which is long along the width direction of the print medium. A portion of the platen 23 facing the print head 22 is a plain surface and is a sheet support surface. The platen 23 is fixedly disposed in a housing of the printer.

The print head 22 is mounted on a head carrier 25. A main shaft 26 to support the head carrier 25 rotatably passes through the head carrier 25. The head carrier 25 is slidable with respect to the main shaft 26. Accordingly, the head carrier 25 is movable in the width direction of the print medium. Besides, a home position sensor 38 is provided which detects whether the print head 22 or the head carrier 25 is positioned at a home position.

A guide beam 27 which is long in the longitudinal direction of the platen 23 and faces the platen 23 through the head carrier 25 is fixed in the housing of the printer. The head carrier 25 is guided by this guide beam 27, so that the print head 22 slides in the longitudinal direction of the platen 23.

The main shaft 26 is moved in the direction of approaching or separating from the platen 23 by a movement mechanism 28.

Figure 2:
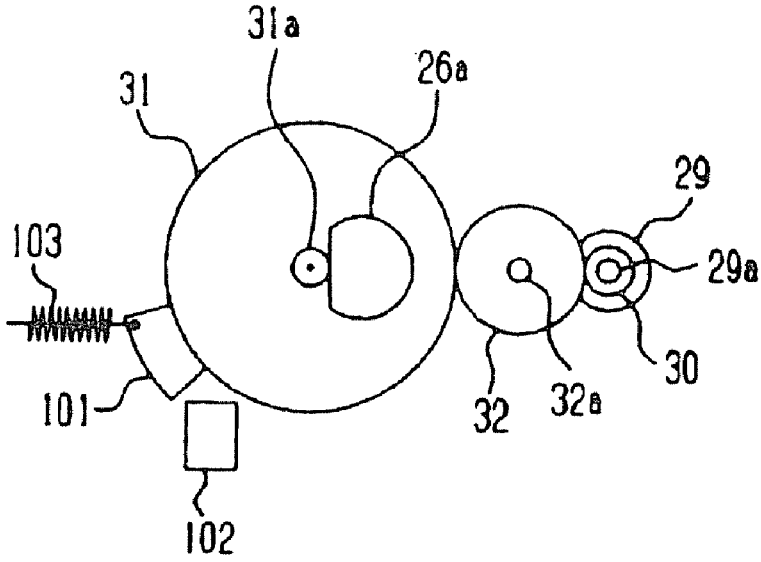
FIG. 2 is a front view of a movement mechanism.

FIG. 2 is a front view of the movement mechanism 28. The movement mechanism 28 includes a stepping motor 29, a drive gear 30 attached to a rotation shaft 29*a* of the stepping motor 29, a driven gear 31 to which one end of the main shaft 26 is fixed, and a transmission gear 32 to transmit the rotation of the drive gear 30 to the driven gear 31. Center shafts 31*a* and 32*a* as the respective rotation centers of the driven gear 31 and the transmission gear 32 are rotatably supported by a not-shown frame of the printer, and are put in a state where their positions are fixed. The main shaft 26 has a D-cut coupling unit 26*a* at the one end fixed to the driven gear 31. The coupling unit 26*a* is fitted in the driven gear 31 at a position eccentric from its rotation center and is fixed.

Figure 3:
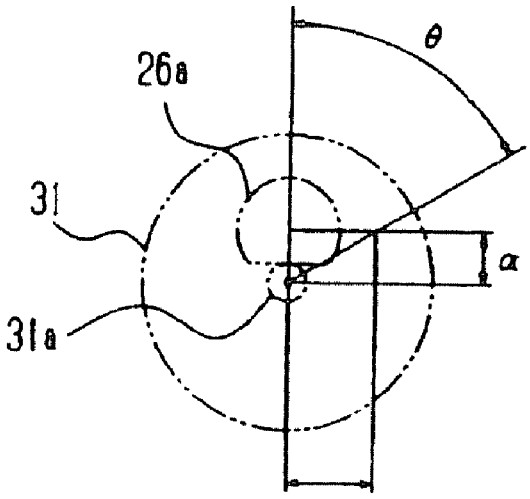
FIG. 3 is an explanation view showing a positional relation between a main shaft and a driven gear.

FIG. 3 is an explanatory view showing a positional relation between the main shaft 26 and the driven gear 31. The main shaft 26 is attached such that its axial center is eccentric from the rotation center of the driven gear 31 by a specified distance $\alpha$. Accordingly, a movement amount E of the main shaft 26 when the driven gear 31 is rotated by an angle $\theta$ is $E=\alpha \sin \theta$. Accordingly, in the movement mechanism 28, when the stepping motor 29 is forwardly rotated, the driving force of the stepping motor 29 is transmitted through the driven gear 30 and the transmission gear 32 and the driven gear 31 is rotated, and the print head 22 is moved in the direction of approaching the platen 23. Besides, when the stepping motor 29 is reversely rotated, the print head 22 is moved in the direction of separating from the platen 23.

Here, as shown in FIG. 1 and FIG. 2, the driven gear 31 has a detection piece 101 protruding from its outer peripheral surface. The printer is provided with an optical sensor 102 to detect the detection piece 101 according to its position. Besides, one end of a tension spring 103 constituting a resistance mechanism is hooked to the detection piece 101. The other end of the tension spring 103 is hooked to, for example, a not-shown frame at the printer side. In this case, irrespective of the rotation position of the driven gear 31, the tension spring 103 is held in a state where its tensile force acts. By this, the tension spring 103 applies rotation resistance to the driven gear 31.

Figure 4:
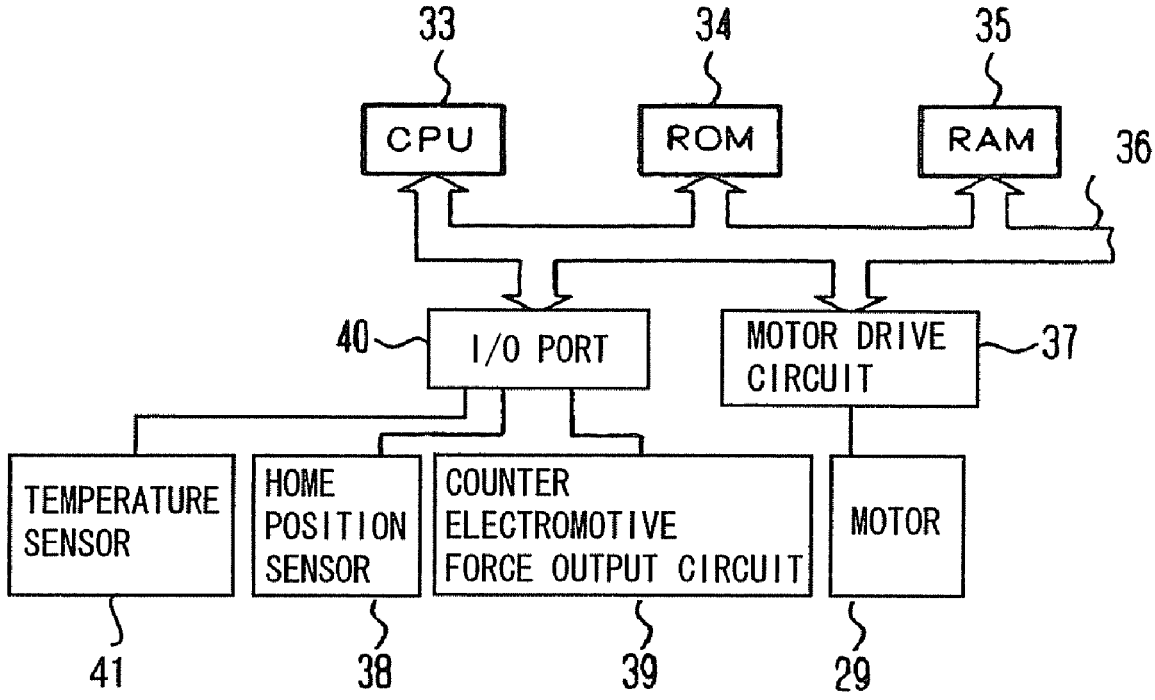
FIG. 4 is a block diagram showing electrical connection of respective units provided in the printer.

FIG. 4 is a block diagram showing electrical connection of respective units provided in the printer. A CPU 33 to execute various arithmetic processings and to concentrically control the respective units is bus-connected to a ROM 34 and a RAM 35 through a system bus 36. The CPU 33 is connected through the system bus 36 to a motor drive circuit 37 to drive the stepping motor 29, a home position sensor 38 as a sensor, and an I/O port 40 to input an external signal such as an output signal from a counter electromotive force output circuit 39. The motor drive circuit 37 performs 4-phase 2-excitation driving of the stepping motor 29. The home position sensor 38 detects that the print head 22 is positioned at a reference position as a position sufficiently spaced from the platen 23.

An operation program of the printer is stored in the ROM 34, and the CPU 33 controls the respective units in accordance with this operation program.

The RAM 35 temporarily stores various variable information. Besides, a partial area of the RAM 35 is used as a print buffer or as various counter areas. In this embodiment, the RAM 35 is used also as a counter to count the number of steps of the stepping motor 29. In another embodiment, a counter to count the number of steps of the stepping motor 29 may be a hardware structure which is connected to, for example, the I/O port 40 and inputs a signal to the CPU 33.

Although not shown, the system bus 36 is connected to the print head 22 constituting the printer, a display such as an LED, a keyboard provided with a key for feeding a print medium, a circuit for driving and controlling a transport mechanism etc., and the like.

The printer includes a cover sensor (not shown) to detect opening of a cover of a printer main body. For example, a leaf switch can be used as the cover sensor. The output from the cover sensor is sent to, for example, the CPU 33.

The printer includes a temperature sensor 41 to detect the temperature of the print head 22. The output from the temperature sensor 41 is sent to, for example, the CPU 33. In view of operation compensation of a high temperature state of the temperature sensor 41, one end of a member, such as a heat pipe, excellent in thermal conduction is attached to the print head 22, the other end is disposed at a position spaced from the print head 22, and the temperature sensor 41 may be attached thereto.

Besides, an indicator to display setting items to the printer, an operation state and the like may be provided.

Figure 5:
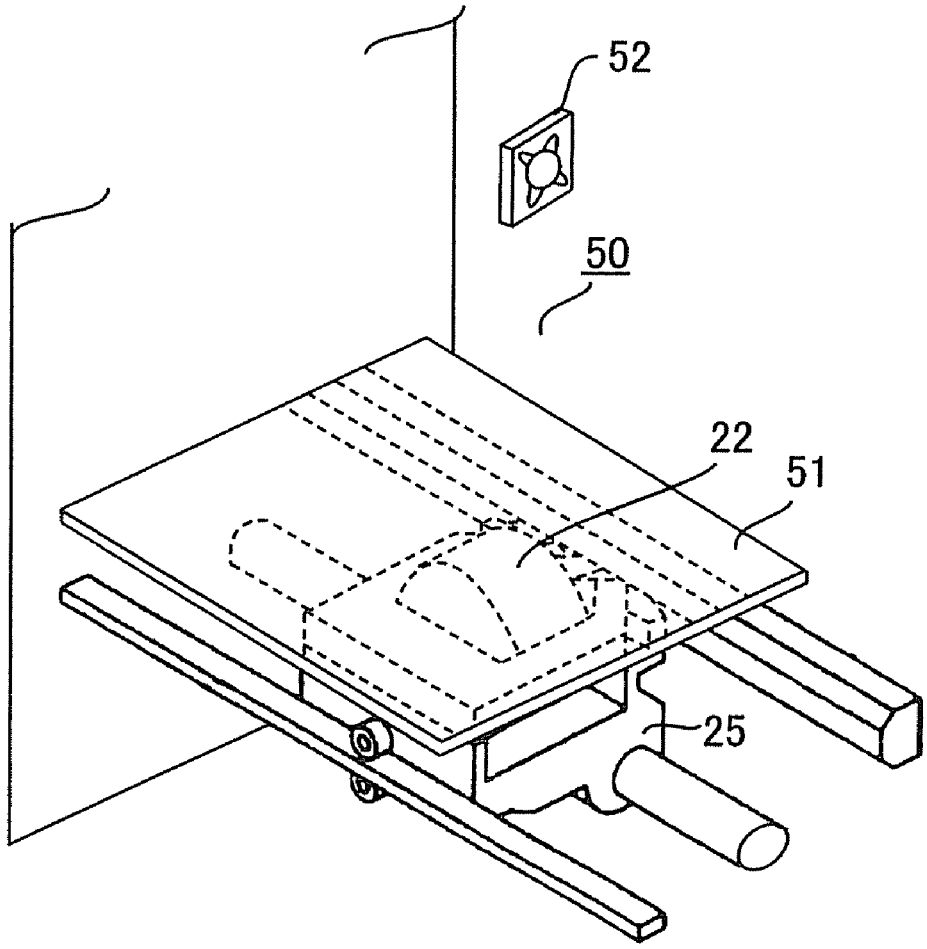
FIG. 5 is a perspective view showing a state in which a print unit is retracted.

As shown in FIG. 5, a retracting section 50 is formed in the housing of the printer. The retracting section 50 is formed as an area for housing the head carrier 25 on which the print head 22 is mounted. The retracting section 50 is formed at one end side (left side in FIG. 5) of the main shaft 26.

When the head carrier 25 moves along the main shaft 26 and comes to the one end side, the whole is surrounded by the retracting section 50. Incidentally, the surrounding by the retracting section 50 does not mean that the whole head carrier 25 is completely covered. That is, since the retracting section is for keeping the whole head carrier 25 away from the user's hand or the like, according to an individual printer, a shield plate 51 has only to be provided above the head carrier 25. Besides, the retracting section may be one which covers the upper part and the front part of the head carrier 25, that is, the surface facing the user side.

In order to radiate heat accumulated in the inside of the housing of the printer or to cool the print head 22, a cooling fan 52 can be disposed in the vicinity of the retracting section 50.

The control unit of the printer including the CPU 33 and the like performs the control as described below.

(1) In the case where the cover is in an open state, and temperature of the print head unit is a specified value A or higher.

The head carrier 25 on which the print head 22 is mounted is moved to the retracting section 50. The specified value A here is such a value that in a case where the user touches the print head 22 or its vicinity, there is a fear that trouble such as a burn occurs. As a result, even in the cover open state, there is no fear that the user erroneously touches the print head 22 of high temperature.

In the case where the print head 22 is retracted to the retracting section 50, for example, the user can not perform the exchange of an ink ribbon. However, at the time point when the temperature is lowered to such a temperature that the print head is safe even if the user's hand touches it, the head carrier 25 can be moved from the retracting section 50.

(2) In the case where the cover is in an open state, and temperature of the print head unit is lower than a specified value B.

After the head carrier 25 on which the print head is mounted is once moved to the retracting section 50, it is returned to the original position. The specified value B here is such a value that even in the case where the user touches the print head 22 or its vicinity, he/she does not get burned. In the case where the user opens the cover shortly after the start of work, the temperature of the print head 22 is not very high. Then, the print head 22 is returned to the original position, and the resumption of the interrupted work can be smoothly performed.

Incidentally, it is a matter of course that the control may be performed such that the head carrier 25 is not once moved to the retracting section 50, but remains at the original position.

(3) In the case where irrespective of the cover open, temperature of the print head unit is a specified value C or higher.

The head carrier 25 on which the print head 22 is mounted is moved to the retracting section 50. The specified value C here is such a value that the print head 22 is excessively heated, and there is a fear that print performance is impaired. Since the cooling fan 52 is disposed in the vicinity of the retracting section 50, the overheat of the print head 22 is removed in a short time, and therefore, the print performance is not impaired.

In relation to the above control, in the case where the head carrier 25 is moved to the retracting section 50, it is user-friendly and desirable that the display unit of the printer main body is made to display the retracting of the head carrier 25.

Incidentally, when the temperature of the print head 22 becomes close to the specified value A or the specified value C, it is also possible to perform control so that the stroke of movement of the head carrier 25 in the width direction of the print medium is made longer than usual on the retracting section 50 side, and retracting to the retracting section 50 can be quickly performed.

According to the invention, in the case where the print head is hot, at the time when the cover is opened, the print head is retracted to the position where the user's hand does not touch, and when it is cooled to the specified temperature or lower, the print head is moved to a position where the user can touch, and therefore, the safety of the user can be ensured.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A printer comprising:

a head carrier on which a print head is mounted;

a cover open sensor to detect opening of a cover of a printer main body;

a temperature sensor to detect temperature of the print head;

a retracting section that is provided at one end side of a span in which the head carrier travels and that shields the print head; and a control unit to control respective units of the printer, wherein the control unit moves the head carrier to the retracting section in a case where the temperature of the print head detected by the temperature sensor is a specified value or higher and the cover open sensor detects opening of the cover of a printer main body.

2. The printer according to claim 1, wherein in a case where the head carrier is moved to the retracting section, a display unit of a printer main body displays retracting of the head carrier.

3. The printer according to claim 1, wherein a cooling fan is disposed near the retracting section.

4. A printer comprising:

a head carrier on which a print head is mounted;

a cover open sensor to detect opening of a cover of a printer main body;

a temperature sensor to detect temperature of the print head;

a retracting section that is provided at one end side of a span in which the head carrier travels and that shields the print head; and a control unit to control respective units of the printer, wherein at a time of opening of the cover, in a case where the temperature of the print head detected by the temperature sensor is a specified value or higher, the control unit moves the head carrier to the retracting section.

5. The printer according to claim 4, further comprising a position sensor to detect a position of the head carrier.

6. The printer according to claim 4, wherein the retracting section is a shield plate to hide the head carrier from a user and is attached to a housing of the printer.

7. The printer according to claim 4, wherein in a case where the temperature of the print head detected by the temperature sensor is a second specified value or lower, the control unit does not move the head carrier from a present position.

8. The printer according to claim 4, wherein in a case where the head carrier is moved to the retracting section, a display unit of a printer main body displays retracting of the head carrier.

9. The printer according to claim 4, wherein a cooling fan is disposed near the retracting section.

* * * * *